US009761138B2

(12) United States Patent
Harter et al.

(10) Patent No.: US 9,761,138 B2
(45) Date of Patent: Sep. 12, 2017

(54) AUTOMATIC YARD MOVE STATUS

(71) Applicant: J. J. Keller & Associates, Inc., Neenah, WI (US)

(72) Inventors: Thomas C. Harter, Neenah, WI (US); Michael K. Kuphal, Greenville, WI (US); Bruce D. Lightner, La Jolla, CA (US)

(73) Assignee: J. J. Keller & Associates, Inc., Neenah, WI (US)

( * ) Notice: Subject to any disclaimer, the term of this patent is extended or adjusted under 35 U.S.C. 154(b) by 4 days.

(21) Appl. No.: 14/851,243

(22) Filed: Sep. 11, 2015

(65) Prior Publication Data

US 2017/0076601 A1 Mar. 16, 2017

(51) Int. Cl.
*G08B 21/00* (2006.01)
*G08G 1/123* (2006.01)
*G08G 1/056* (2006.01)

(52) U.S. Cl.
CPC ..... *G08G 1/123* (2013.01); *G08G 1/056* (2013.01)

(58) Field of Classification Search
CPC ..... G07C 5/08; H04L 67/12
USPC ..... 340/431, 540, 541
See application file for complete search history.

(56) References Cited

U.S. PATENT DOCUMENTS 5,359,528 A 10/1994 Haendel et al.
5,694,322 A 12/1997 Westerlage et al.
5,928,291 A 7/1999 Jenkins et al.
5,970,481 A 10/1999 Westerlage et al.
6,253,129 B1 6/2001 Jenkins et al.
6,571,168 B1 5/2003 Murphy et al.
6,614,394 B2 9/2003 Honda et al.
6,714,857 B2 3/2004 Kapolka et al.
7,072,746 B1 7/2006 Burch
7,117,075 B1 10/2006 Larschan et al.
7,880,599 B2 * 2/2011 Murray ..... B60R 25/04 340/441
7,881,838 B2 2/2011 Larschan et al.
7,996,150 B2 8/2011 Nishida
8,018,329 B2 9/2011 Morgan et al.
8,032,277 B2 10/2011 Larschan et al.
8,149,163 B2 4/2012 Toda
8,284,069 B2 10/2012 Sverrisson
8,442,508 B2 5/2013 Harter et al.
8,620,515 B2 12/2013 Kwak
8,626,568 B2 1/2014 Warkentin et al.
8,805,418 B2 8/2014 Nichols
8,909,248 B2 12/2014 Phillips et al.
(Continued)

OTHER PUBLICATIONS

Federal ELD Regulations, published in the Federal Register, vol. 79, No. 60, Mar. 28, pp. 17655-17724 (2014).
(Continued)

*Primary Examiner* — Tai T Nguyen
(74) *Attorney, Agent, or Firm* — Michael Best & Friedrich LLP

(57) ABSTRACT

Systems and methods for the automatic detection of yard move status for drivers of commercial motor vehicles (CMV). One method includes defining a geo-fenced region for a yard and determining a location of the vehicle in relation to the geo-fenced region. The location is used, along with other vehicle and driver parameters, to automatically detect a start of the yard move status and an end of the yard move status using a processor.

28 Claims, 6 Drawing Sheets

(56) References Cited

U.S. PATENT DOCUMENTS

| | | | | |
|---|---|---|---|---|
| 2002/0154035 | A1 | 10/2002 | Flick | |
| 2002/0154036 | A1 | 10/2002 | Flick | |
| 2002/0173887 | A1 | 11/2002 | Flick | |
| 2003/0163249 | A1 | 8/2003 | Kapolka et al. | |
| 2004/0243285 | A1 | 12/2004 | Gounder | |
| 2005/0060070 | A1 | 3/2005 | Kapolka et al. | |
| 2007/0050108 | A1 | 3/2007 | Larschan et al. | |
| 2007/0067228 | A1 | 3/2007 | Furman | |
| 2007/0129878 | A1 | 6/2007 | Pepper | |
| 2007/0177605 | A1 | 8/2007 | Benco et al. | |
| 2009/0006107 | A1 | 1/2009 | Golden | |
| 2010/0061190 | A1 | 3/2010 | Nelson | |
| 2010/0148947 | A1* | 6/2010 | Morgan | B60R 25/04 340/426.22 |
| 2011/0218896 | A1 | 9/2011 | Tonnon et al. | |
| 2012/0303256 | A1 | 11/2012 | Morgan et al. | |
| 2013/0006519 | A1 | 1/2013 | Doherty et al. | |
| 2013/0024084 | A1 | 1/2013 | Yamashiro | |
| 2013/0031029 | A1 | 1/2013 | Davidson | |
| 2013/0054135 | A1 | 2/2013 | Backsen, Jr. | |
| 2013/0226397 | A1 | 8/2013 | Kuphal et al. | |
| 2013/0302758 | A1 | 11/2013 | Wright | |
| 2013/0342343 | A1 | 12/2013 | Harring et al. | |
| 2015/0100199 | A1 | 4/2015 | Kurnik et al. | |
| 2015/0112542 | A1 | 4/2015 | Fuglewicz | |
| 2015/0178737 | A1 | 6/2015 | Simpson et al. | |
| 2016/0180721 | A1* | 6/2016 | Otulic | G08G 9/02 701/2 |
| 2016/0261622 | A1 | 9/2016 | Danielson et al. | |
| 2017/0001653 | A1 | 1/2017 | Ferencz, Jr. et al. | |

OTHER PUBLICATIONS

Comments by Eclipse Software Systems to Proposed Federal ELD Regulations, published at http://www.regulations.gov under docket No. FMCSA-2010-0167 at least as early as Jul. 29, 2015.

Comments by Inthinc Technology Solutions to Proposed Federal ELD Regulations, published at http://www.regulations.gov under docket No. FMCSA-2010-0167, Jun. 25, 2014.

Comments by Omnitracs, LLC to Proposed Federal ELD Regulations, published at http://www.regulations.gov under docket No. FMCSA-2010-0167 at least as early as Jul. 29, 2015.

Comments by Zonar Connected to Proposed Federal ELD Regulations, published at http://www.regulations.gov under docket No. FMCSA-2010-0167 at least as early as Jul. 29, 2016.

Comments by XRS Corporation to Proposed Federal ELD Regulations, published at http://www.regulations.gov under docket No. FMCSA-2010-0167 at least as early as Jul. 29, 2017.

Comments by Saucon Technologies to Proposed Federal ELD Regulations, published at http://www.regulations.gov under docket No. FMCSA-2010-0167, Jun. 12, 2014.

Office Action from the US Patent and Trademark Office from U.S. Appl. No. 14/851,252 dated Sep. 28, 2016 (14 pages).

Notice of Allowance from the US Patent and Trademark Office for U.S. Appl. No. 14/851,261 dated Apr. 4, 2017 (6 pages).

Office Action from the US Patent and Trademark Office for U.S. Appl. No. 14/851,232 dated May 18, 2017 (70 pages).

* cited by examiner

AUTOMATIC YARD MOVE STATUS

BACKGROUND

Embodiments of the invention relate to systems and methods for the automatic detection of yard move status for drivers of commercial motor vehicles.

Operators of commercial motor vehicles ("CMV's") are required to meet certain specific performance standards and regulations for operating such vehicles. For example, some operators of the CMV's are required to meet hours-of-service regulations.

The current U.S. Department of Transportation proposal requires a driver to select on an Electronic Logging Device (ELD) the applicable special driving category before the start of the status and deselect when the indicated status ends. One of the special driving category statuses is the yard move status.

SUMMARY

One embodiment of the invention provides a method of detecting a yard move status for a driver of a commercial motor vehicle. The method includes defining a geo-fenced region for a yard and determining a location of the vehicle using a positioning system and the geo-fenced region. The method also includes automatically detecting a start of the yard move status and an end of the yard move status using a processor.

Another embodiment of the invention provides a system configured to detect a yard move status for a driver of a commercial motor vehicle. The system includes a base unit installed in the vehicle, at least one processor, and at least one physical computer storage medium. The at least one physical computer storage medium includes stored executable instructions that, when executed by the at least one processor, cause the at least one processor to perform operations to detect the yard move status. The operations include defining a geo-fenced region for a yard and determining, using a positioning system and the geo-fenced region, a location of the vehicle. The operations also include automatically detecting a start of a yard move status and an end of a yard move status using a processor.

Another method includes at least one physical computer storage medium including stored instructions. The stored instructions, when executed, detect yard move status for a driver of a commercial motor vehicle. The at least one physical storage medium includes instructions which, when executed by a processor, perform operations which include determining a location of the vehicle using a positioning system and a geo-fenced region. The operations also include automatically detecting a start of a yard move status, and automatically detecting an end of a yard move status.

In each of the embodiments, distributed processing divides certain tasks between a base unit and a portable device. The base unit defines boundaries and detects when the vehicle crosses those boundaries. The portable device prompts the driver to identify the start of a yard move status. The portable device also automatically ends a yard move status. There are numerous benefits to this distributive processing including a reduced load, increased speed, and a better response time.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being carried out in various ways.

In one particular embodiment, the invention provides a system for logging performance of a driver operating a vehicle having a vehicle information system from which at least one vehicle operating parameter may be obtained in a performance monitoring process. The vehicle operating parameters collected through the vehicle information system and information such as operator identity from a portable device are wirelessly communicated to a remote host through a network such as the Internet.

Figure 1:
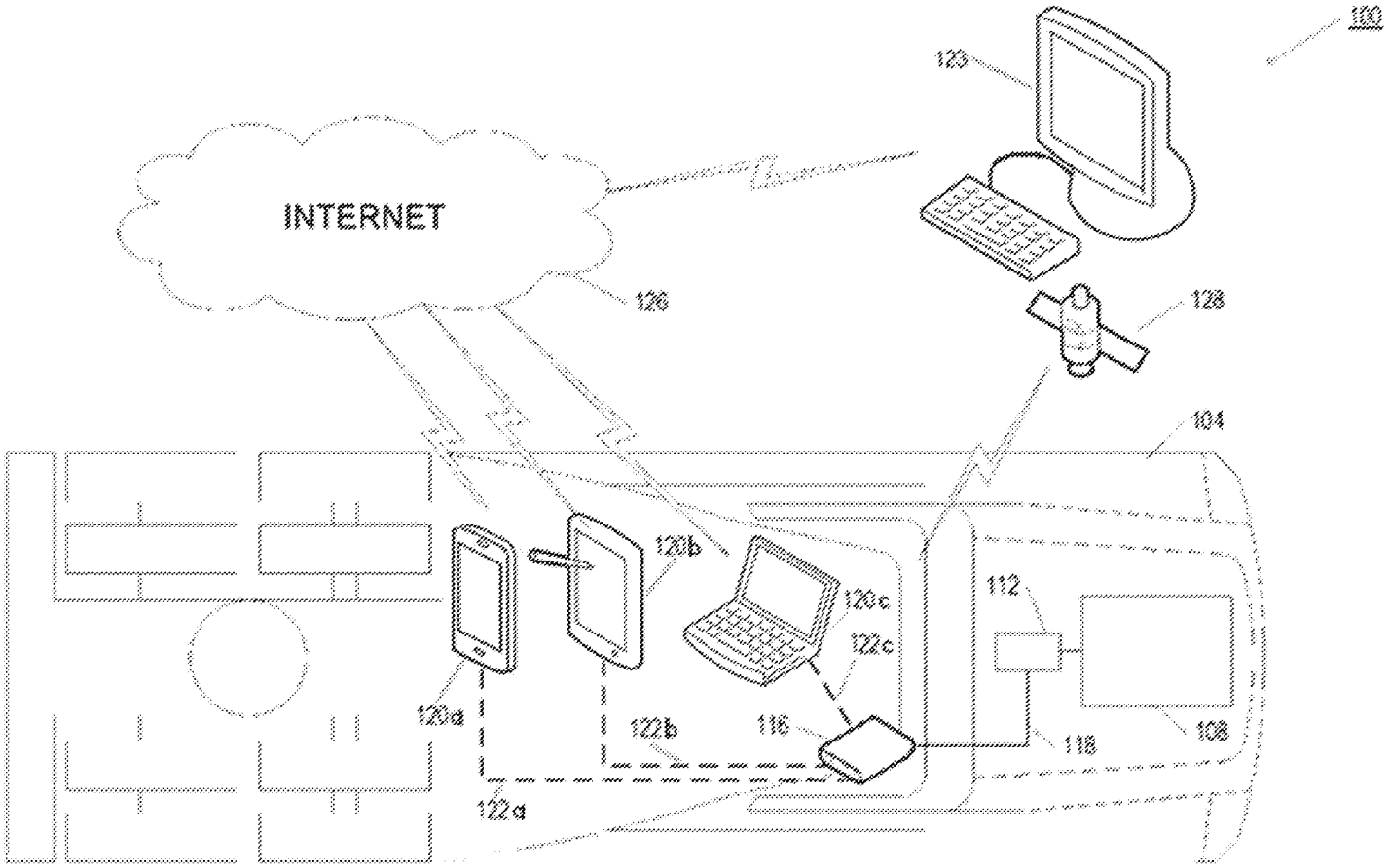
FIG. 1 is a schematic illustration of a system structured in accordance with an embodiment of the invention.

FIG. 1 shows a performance monitoring system 100 for use with a commercial motor vehicle ("CMV") 104. Although the CMV 104 illustrated is a tractor configured to tow a trailer (not shown), the performance monitoring system 100 can also be implemented in other types of CMV's such as construction vehicles and agricultural equipment. The CMV 104 includes an engine 108 that drives the CMV 104, and is controlled by an electronic control unit ("ECU") 112 that determines operating information or parameters from the engine 108, and other parts of the CMV 104. Operating parameters monitored by the ECU 112 include speed, hours of service, operating status, ignition switch status, trip distance, total vehicle distance, and the like.

The performance monitoring system 100 also includes an electronic on-board recorder ("EOBR") base unit 116 that communicates with the ECU 112 through an information bus 118 conforming to standards such as SAE J1939 and SAE J1708 network buses. The base unit 116 has a plurality of functions including, but not limited to, time keeping and data logging. In one implementation, the base unit 116 records and stores CMV information or data from the ECU 112 that is necessary to comply with U.S. Department of Transportation regulations such as those mentioned above. The performance monitoring system 100 also includes a portable device such as a mobile phone 120*a*, a tablet 120*b*, a laptop computer 120*c*, or the like, that communicates with the base unit 116. The portable device may be an Android, Apple iOS, Microsoft Windows or similar based device. In one embodiment, the portable device includes an application for logging purposes. The application processes and stores data from the base unit 116 retrieved from the information bus 118. The application allows for manual entries made by the driver. The application also generates Hours of Service (HOS) compliance data, vehicle performance data, and driver performance data. This data included driving time and driving distance. The base unit 116 communicates with the portable device through a cable or wireless link 122*a*, 122*b*, 122*c*. The link 122*a*, 122*b*, 122*c* may be a serial cable, such as a USB cable. Other exemplary links include a wireless personal-area-network such as Bluetooth, Wi-Fi, Near Field Communication, and the like. The portable device generally supports multiple platforms such as smart phones 120*a*, tablets 120*b*, and computers such as laptops 120*c*.

The performance monitoring system 100 includes a remote server 123 running a remote application that wirelessly communicates with the portable device via a network such as the Internet, detailed hereinafter. An application on the portable device may send data to the remote server 123 for viewing, reporting, and analyzing. A global position satellite ("GPS") system or other positioning system 128 also communicates with the ECU 112 and/or the base unit 116 so that information from the GPS system 128 (such as time and location) is available to the CMV 104. In some embodiments, at least a portion of the information stored in the base unit 116 or information communicated to and from the base unit 116 is encrypted.

Processing is distributed or shared between the base unit 116 and the portable device. The base unit 116 stores geo-fenced boundaries for the home terminal location, herein referred to as "the work reporting location." The base unit 116 uses coordinates from the GPS system 128 and determines if those coordinates are within the geo-fenced region. The base unit generates an event which identifies whether a point is within the geo-fenced region.

The portable device process prompts the driver to identify the start of a yard move status. The portable device also automatically ends a yard move status when it determines that a vehicle is no longer within the geo-fenced boundary. In another embodiment when the end of a yard move status is detected, the portable device prompts the driver to declare the end of a yard move status.

In another embodiment, the portable device maintains all logic including the geo-fenced data. The base unit 116 is only responsible for reporting the vehicle location and odometer at preset intervals in real-time.

Figure 2:
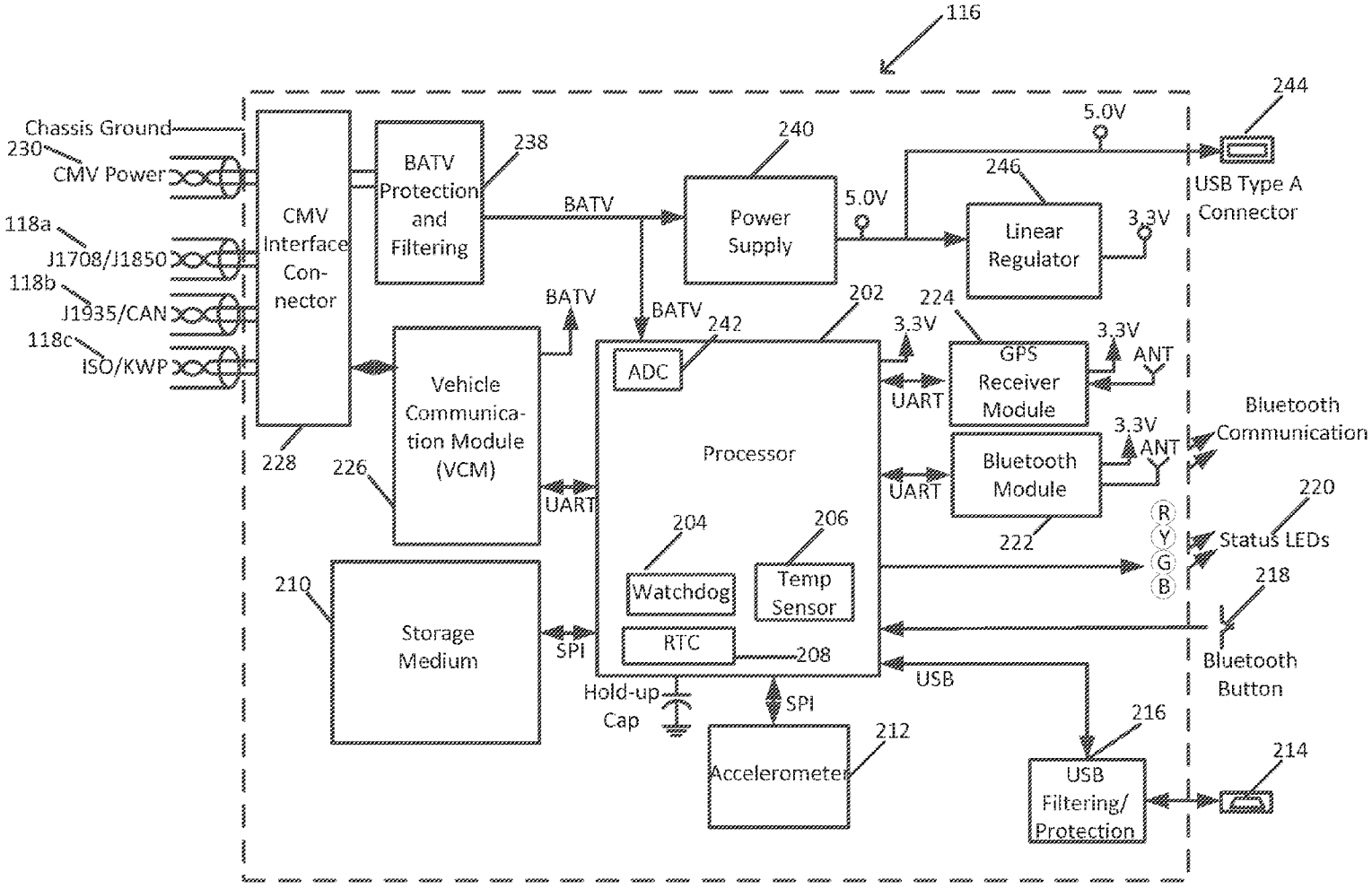
FIG. 2 illustrates a base unit of the system in FIG. 1 in a block diagram format.

FIG. 2 shows the base unit 116 in a block diagram format. The base unit is a low-power, custom designed telematics device that incorporates a processor 202. In another embodiment, the base unit 116 is a telematics device which gathers vehicle data from the on-board diagnostic (OBD) connector and includes a GPS receiver.

As shown, the base unit 116 includes a processor (such as a microprocessor, controller or application-specific-integrated-circuit ("ASIC") 202. The processor 202 preferably includes a custom programmed STM32ARM Cortex M3 microcontroller with 768 Kbytes of program flash memory and 96 Kbytes of static RAM memory, running a free license Real Time Operating System such as FreeRTOS. The processor includes a watchdog 204, temperature sensor 206, and real-time clock (RTC) 208, which provides a real-time clock function to allow software to accurately determine a time with a predetermined resolution. In some embodiments, the RTC 208 is required to remain operational while the CMV 104 (FIG. 1) does not provide power to the base unit 116.

The processor 202 is coupled to a storage medium 210. The storage medium 210 is physical, non-transient storage device. The storage medium 210 is preferably a non-volatile megabyte flash memory device 32, but could also be any type of non-volatile flash memory including a NAND or NOR interface or a serial or parallel interface. In addition, the storage medium 210 may be a combination of RAM, ROM, EEPROM, CD-ROM, magnetic disk storage, other magnetic storage devices, or any other medium that could be used to store computer executable instructions or data structures.

The processor 202 is coupled to an accelerometer 212. The base unit 116 also includes a USB micro AB connector 214 to transmit and receive data through a USB connector of an external portable device. The received data is filtered and protected with a USB protection and filtering module 216 before going to the processor 202. The processor 202 is coupled to a Bluetooth button 218. Additionally, the processor 202 displays the status of the base unit 116 with a plurality of status light-emitting-diodes 220 that are red (R), yellow (Y), blue (B), and green (G).

To communicate with the portable device, the base unit 116 includes a Bluetooth Module 222 configured to be connected to the processor. To receive a GPS signal from the GPS system 128 (FIG. 1), the base unit 116 includes a GPS receiver module configured to be connected to the processor.

The processor 202 is coupled to a vehicle communication module (VCM) 226. The VCM 226 preferably incorporates a custom programmed STM32ARM Cortex M3 microcontroller with 64 Kbytes of programmed flash memory and 20 KB of static RAM memory. This VCM 226 is coupled to a CMV 228 interface connector that connects to the CMV power bus 230. Bus 230 provides communication between the ECU 112 (FIG. 1) and the SAE J1708/SAE J1850 network bus 118*a*, the SAE J1939/CAN network bus 118*b*, and the ISO/KWP bus 118*b*. KWP is a Keyword Protocol promulgated by the International Organization for Standardization.

In the embodiment shown, the base unit 116 receives its power from the CMV 104 through the CMV interface connector 228 and a CMV power bus 230. The power is regulated and surge-protected with a Battery Voltage (BATV) protection and filtering system 238, and a power supply circuit 240 that is preferably a 5.0 V switch mode power supply. This power supply and voltage protection and filtering system 238 are coupled to the processor 202, where the signals are converted with the Analog-to-Digital Converter (ADC) 242. The power supply 240 is also connected to USB type A connector 244 and a linear regulator 246. Preferably, the linear regulator is a 3.3V low-dropout (LDO) linear regulator.

Figure 3:
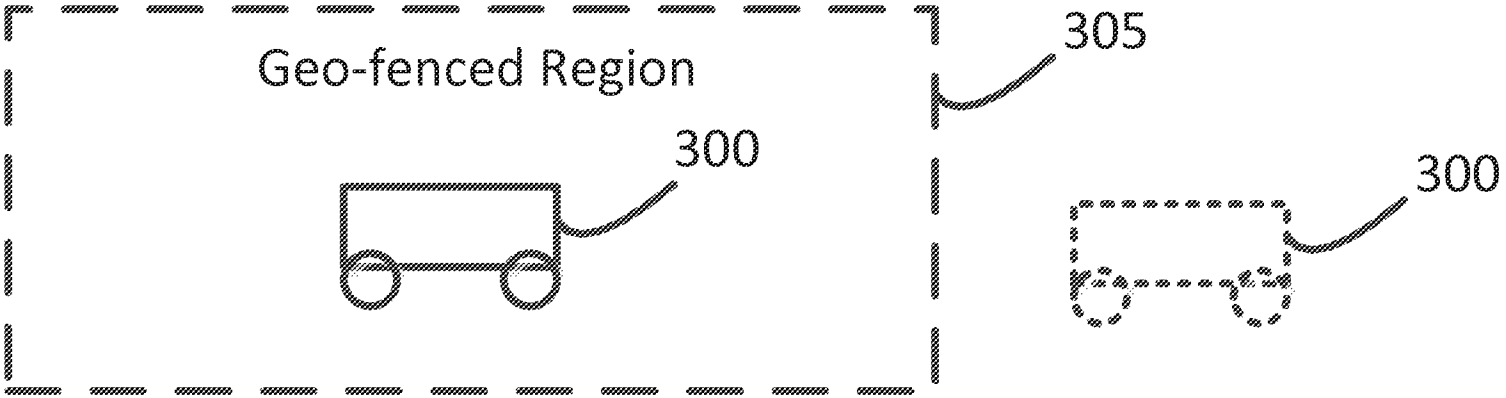
FIG. 3 is the location of a vehicle relative to a geo-fenced region.

FIG. 3 shows the yard move status of a vehicle 300 based on its location relative to a geo-fenced region 305. The geo-fenced region 305 is the normal work reporting location. It may coincide with a physical fence, or the geo-fenced region 305 may be a portion of the area within a physical fence. In order to detect a yard move status for the driver of a CMV, the physical computer storage medium includes instructions that, when executed by at least one processor 202 (FIG. 2) determine whether the vehicle 300 has started or whether a driver has changed, i.e. whether the CMV has a different driver from the previous driver. The start of a vehicle 300 may be detected by a sensor interconnected with the vehicle ignition system or using another method. The driver change may be detected through a mobile device 120*a* (FIG. 1), tablet 120*b* (FIG. 1), computer 120*c* (FIG. 1), or similar apparatus that includes an application programmable to be associated with the driver.

Once the start of the vehicle or the driver change has been detected, the location of the vehicle is determined using a GPS system 128 (FIG. 1) and the geo-fenced region 305. The physical computer storage medium includes instructions that are executed using a processor 202 (FIG. 2) to determine if a vehicle is located within the geo-fenced region 305. If the vehicle is not initially located within the geo-fenced region 305 after the vehicle start or driver change, then the processor 202 (FIG. 2) automatically detects that the vehicle is not making a yard move. The process to automate identifying a yard move status is terminated.

If the vehicle 300 is in the geo-fenced region 305 when there is a vehicle start or driver change then the processor detects if the vehicle 300 is moving. The base unit 116 (FIG. 1) monitors the vehicle speed reported over one or more of the vehicle's on-board diagnostics (OBD) busses and/or by monitoring the odometer of vehicle 300 as reported over the OBD bus or busses. If the vehicle 300 does not report the odometer over the OBD bus, then the base unit 116 (FIG. 1) creates an artificial odometer by integrating periodic vehicle speed readings from the OBD bus. The artificial or integrated odometer can be used to monitor the vehicle's relative movement (i.e. distance traveled since ignition). If the vehicle 300 is moving, then the vehicle movement is monitored until it stops or the vehicle 300 leaves the geo-fenced region 305.

In another embodiment, the GPS receiver module 224 (FIG. 2) reports both vehicle speed and location. The GPS coordinates are used to determine a vehicle speed that can be integrated to create an artificial odometer. Alternatively, successive GPS derived location (i.e. latitude and longitude) can be subtracted to calculate the distance traveled in increments which produces another form of artificial odometer. If the base unit includes an accelerometer, then periodic accelerometer readings can be integrated to derive vehicle speed, and therefore, determine whether the vehicle is moving. If the vehicle 300 is moving, then the vehicle movement is monitored until it stops or the vehicle 300 leaves the geo-fenced region 305.

If the vehicle 300 is not moving inside the geo-fenced region 305, then the processor 202 (FIG. 2) determines if the driver is identified. Additionally, if a yard move was requested manually, then the processor 202 (FIG. 2) determines if the driver is identified. A yard move request can be manually set by the driver using an application on a mobile device 120*a* (FIG. 1), tablet 120*b* (FIG. 1), computer 120*c* (FIG. 1), or similar apparatus. The driver is automatically identified when the driver logs onto an application on a mobile device 120*a* (FIG. 1), tablet 120*b* (FIG. 1), computer 120*c* (FIG. 1), or similar apparatus before the start of a trip. If the driver is not identified, then the driver did not log in and vehicle location and movement are monitored until the vehicle leaves the geo-fenced region, or the driver logs in. If the driver is identified, the processor 202 (FIG. 2) determines if the driver has set a yard move status and prompts the driver to set one if it was not set. This prompt comes from a mobile device 120*a* (FIG. 1), tablet 120*b* (FIG. 1), computer 120*c* (FIG. 1) or similar apparatus. If the driver does not set the yard move status, then the process to automate identifying a yard move status is terminated.

If the driver sets a yard move status, the location of the vehicle 300 is monitored to check that the vehicle is still located in the geo-fenced region 305. If the vehicle is outside the geo-fenced region 305 then the yard move status is terminated because the vehicle 300 is no longer moving within the yard. If the vehicle 300 is in the geo-fenced region 305, then the processor 202 (FIG. 2) checks to see if the driver is still logged in. If the driver is not logged in, then the yard move status is terminated. If the driver is logged in, then a check is run to see if the driver is still in yard move status. If the driver is not in yard move status, then the yard move is terminated. If the driver is still in yard move status, then the processor 202 (FIG. 2) continues to check if the vehicle 300 is in the geo-fenced region 305, and if the driver is still logged in. The driver remains in a yard move status, until the vehicle 300 leaves the geo-fenced region 305, the driver logs out of the application, or the driver changes the yard move status.

Figure 4:
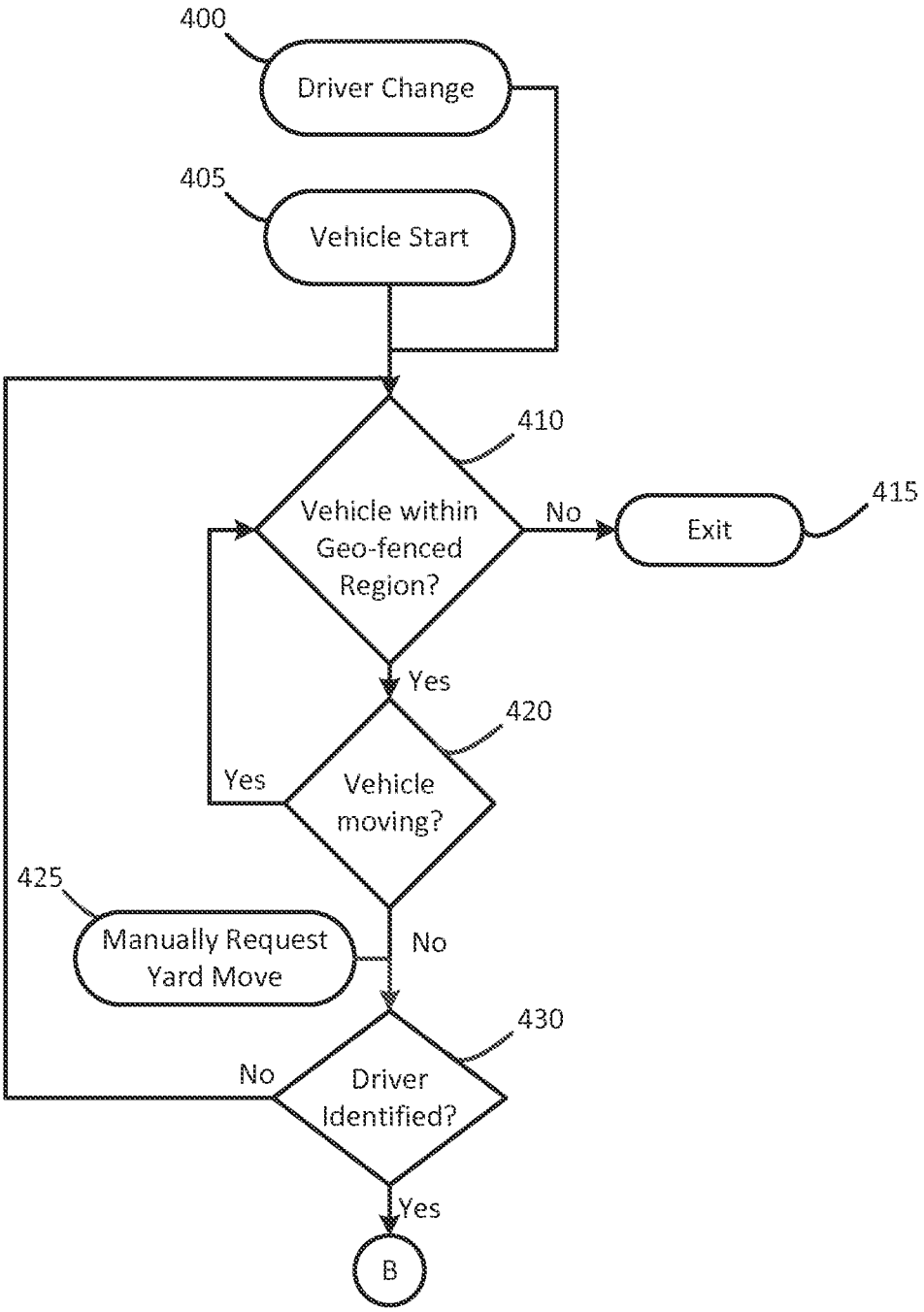
FIG. 4 is a flow diagram to determine yard move status for the beginning of a trip when a driver changes, a vehicle ignition is initiated, or a manual request for a yard move is sent.

FIG. 4 is a flow diagram to determine yard move status for the beginning of a trip when a driver changes, a vehicle starts, or a manual request for a yard move is sent. This process is distributed between the base unit and the portable device to reduce the load, increase speed, and obtain a better response time. In order to detect a yard move status for the driver of a CMV, the physical computer storage medium includes instructions that, when executed by at least one processor 202 (FIG. 2) determine whether the vehicle 300 (FIG. 3) has started 405 or whether a driver has changed 400, i.e. whether the CMV has a different driver from the previous driver. The start of a vehicle 405 may be detected by a sensor interconnected with the vehicle ignition system or using another method. The driver change 400 may be detected through a mobile device 120*a* (FIG. 1), tablet 120*b* (FIG. 1), computer 120*c* (FIG. 1), or similar apparatus that includes an application programmable to be associated with the driver.

Once the start of the vehicle 405 or the driver change 400 has been detected, the location of the vehicle is determined at step 410 using a GPS system 128 (FIG. 1) and the geo-fenced region 305 (FIG. 3). The physical computer storage medium includes instructions that are executed by a processor 202 (FIG. 2) to determine if a vehicle is located within the geo-fenced region 305 (FIG. 3). If the vehicle is not initially located within the geo-fenced region 305 (FIG. 3) after the vehicle start 405 or driver change 400, then the processor 202 (FIG. 2) automatically detects that the vehicle is not making a yard move. The process to automate identifying a yard move status is terminated at step 415.

If the vehicle 300 is in the geo-fenced region 305 when there is a vehicle start 405 or driver change 400, then the processor 202 (FIG. 2) detects if the vehicle 300 (FIG. 3) is moving at step 420. The base unit 116 (FIG. 1) monitors the vehicle speed reported over one or more of the vehicle's on-board diagnostics (OBD) busses and/or by monitoring the odometer of vehicle 300 as reported over the OBD bus or busses. If the vehicle 300 (FIG. 3) does not report the odometer over the OBD bus, then the base unit 116 (FIG. 1) creates an artificial or integrated odometer by integrating periodic vehicle speed readings from the OBD bus. The artificial odometer can be used to monitor the vehicle's 300 (FIG. 3) relative movement (i.e. distance traveled since ignition). If the vehicle 300 (FIG. 3) is moving then the vehicle movement is monitored until it stops or the vehicle 300 (FIG. 3) leaves the geo-fenced region 305 (FIG. 3).

In another embodiment, the GPS receiver module 224 (FIG. 2) reports both vehicle speed and location. The GPS coordinates can be used to determine a vehicle speed that can be integrated to create an artificial odometer. Alternatively, successive GPS derived location (i.e. latitude and longitude) can be subtracted to calculate the distance traveled in increments which produces another form of an artificial odometer. If the base unit includes an accelerometer, then periodic accelerometer readings can be integrated to derive vehicle speed, and therefore, determine whether the vehicle is moving. If the vehicle 300 (FIG. 3) is moving then the vehicle movement is monitored until it stops or the vehicle 300 (FIG. 3) leaves the geo-fenced region 305 (FIG. 3).

If the vehicle 300 (FIG. 3) is not moving inside the geo-fenced region 305 (FIG. 3) then the processor 202 (FIG. 2) determines if the driver is identified at step 430. Additionally, if a yard move was requested manually at step 425, then the processor 202 (FIG. 2) determines if the driver is identified at step 430. A yard move request can be manually set by the driver using an application on a mobile device 120*a* (FIG. 1), tablet 120*b* (FIG. 1), computer 120*c* (FIG. 1), or similar apparatus. The driver is automatically identified when the driver logs onto an application on a mobile device 120*a* (FIG. 1), tablet 120*b* (FIG. 1), computer 120*c* (FIG. 1), or similar apparatus before the start of a trip. If the driver is not identified, then the driver did not log in, and vehicle location and movement are monitored at steps 410 and 420 until the vehicle leaves the geo-fenced region, or the driver logs in. If the driver is identified, the processor 202 (FIG. 2) determines if the driver has set a yard move status at step 500 of FIG. 5.

Figure 5:
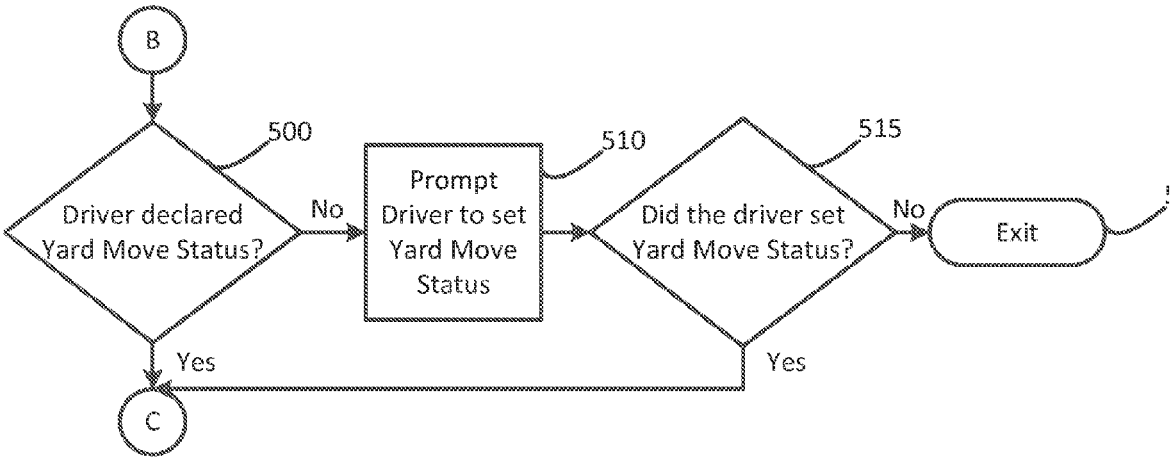
FIG. 5 is a flow diagram to prompt the driver if a yard move status has not been entered.

FIG. 5 is a flow diagram to prompt the driver if a yard move status has not been entered. If the driver is identified as determined in FIG. 5, then the processor 202 (FIG. 2) determines if the driver has set a yard move status at step 500. If a yard move status was not set, then the driver is prompted to set the yard move status at step 510. This prompt comes from a mobile device 120*a* (FIG. 1), tablet 120*b* (FIG. 1), computer 120*c* (FIG. 1), or similar apparatus. If the driver does not set the yard move status as determined at step 515, then the process to automate the identification of a yard move status is terminated at step 520. If the driver sets a yard move status as determined at step 515, the location of the vehicle 300 (FIG. 3) is monitored at step 600 in FIG. 6.

Figure 6:
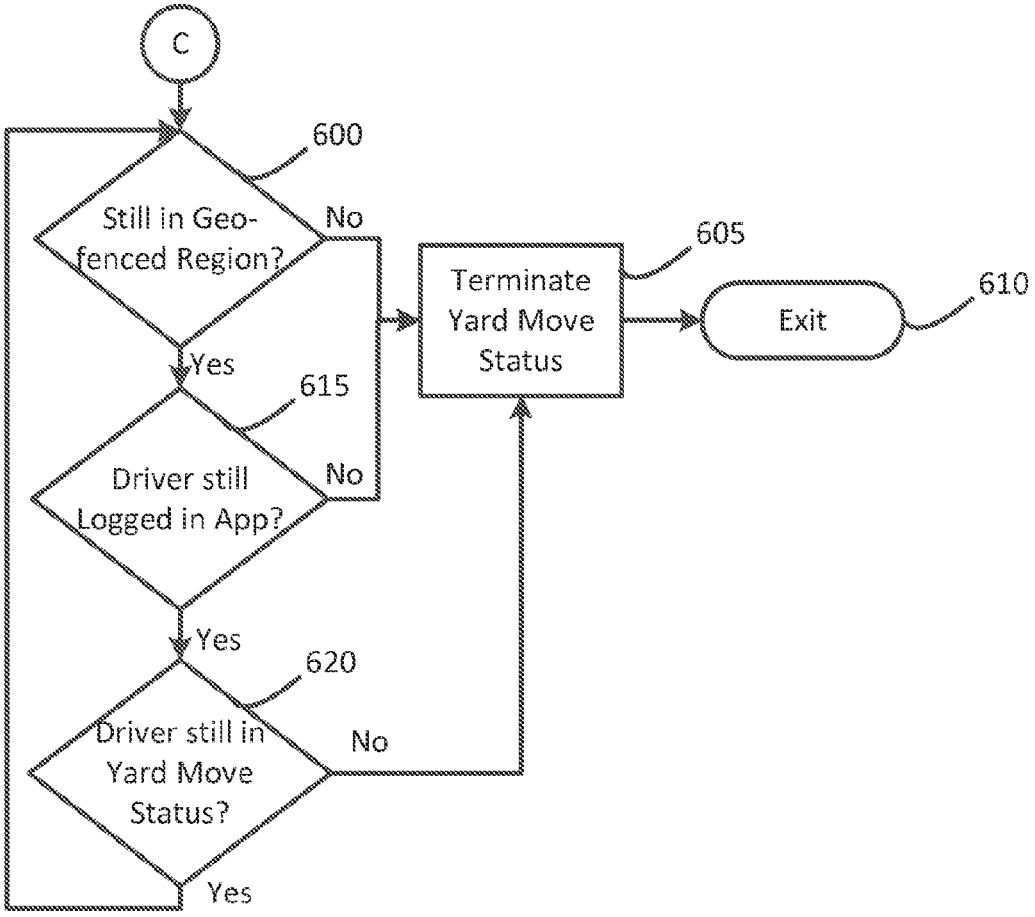
FIG. 6 is a flow diagram to determine if a vehicle and driver remain in a yard move status.

FIG. 6 is a flow diagram to determine if a vehicle and driver remain in a yard move status. This processing is distributed between the base unit and the portable device to reduce the load, increase speed, and obtain a better response time. If the driver sets a yard move status as determined at step 515 of FIG. 5, the location of the vehicle 300 (FIG. 3) is monitored at step 600 to determine if the vehicle is still located in the geo-fenced region 305 (FIG. 3). If the vehicle is outside the geo-fenced region 305 (FIG. 3) then the yard move status is terminated at step 605 because the vehicle 300 (FIG. 3) is no longer moving within the yard, and the routine ends at step 610. If the vehicle 300 (FIG. 3) is in the geo-fenced region 305 (FIG. 3) as determined at step 600, then the processor 202 (FIG. 2) determines if the driver is still logged in at step 615. If the driver is not logged in, then the yard move status is terminated at step 605, and the routine ends at step 610. If the driver is logged in, then the processor 202 (FIG. 2) determines if the driver is still in yard move status at step 620. If the driver is not in yard move status, then the yard move is terminated at step 605, and the routine ends at step 610. If the driver is still in yard move status then the processor 202 (FIG. 2) continues to check if the vehicle 300 is in the geo-fenced region 305, and whether the driver is still logged in. The driver remains in a yard move status until the vehicle 300 (FIG. 3) leaves the geo-fenced region 305 (FIG. 3) at step 600, the driver logs out of the application at step 615, or the driver changes the yard move status at step 620.

Various features and aspects of embodiments of the invention are set forth in the following claims.

What is claimed is:

1. A method of detecting a yard move status for a driver of a commercial motor vehicle, the method comprising:

defining a geo-fenced region for a yard;

determining, using a positioning system and the geo-fenced region, a location of the vehicle;

detecting, using a processor, a start of the yard move status;

identifying, using a processor, the driver of the commercial motor vehicle who is associated with the yard move status; and detecting, using a processor an end of the yard move status.

2. The method of claim 1, further comprising:

providing a portable device; and associating the driver with the portable device.

3. The method of claim 1, wherein detecting the start of a yard move status includes prompting the driver to declare the yard move status.

4. The method of claim 1, wherein detecting the start of a yard move status includes sensing that the vehicle has started.

5. The method of claim 1, wherein detecting an end of a yard move status includes prompting the driver to declare the end of the yard move status.

6. The method of claim 1, further comprising detecting, using a base unit, when the vehicle crosses a geo-fenced boundary.

7. The method of claim 1, further comprising prompting, with a portable device, the driver to declare the yard move status.

8. The method of claim 1, further comprising ending, with a portable device, a yard move status when the vehicle crosses the geo-fenced boundary.

9. A system configured to detect a yard move status for a driver of a commercial motor vehicle, the system comprising:

a base unit installed in the vehicle;

at least one processor;

at least one physical computer storage medium comprising stored executable instructions that when executed by the at least one processor cause the at least one processor to perform operations to detect the yard move status, including:

defining a geo-fenced region for a yard;

determining, using a positioning system and the geo-fenced region, a location of the vehicle;

detecting, using a processor, a start of the yard move status;

identifying, using a processor, the driver of the commercial motor vehicle who is associated with the yard move status; and detecting, using a processor, an end of the yard move status.

10. The system of claim 9, further comprising a positioning system receiver that is in communication with the processor.

11. The system of claim 9, further comprising a portable device that is in communication with the base unit.

12. The system of claim 9, wherein the at least one physical computer storage medium includes instructions that, when executed by the at least one processor, define a geo-fenced region.

13. The system of claim 9, wherein the at least one physical computer storage medium includes instructions that, when executed by the at least one processor, compare the location of the vehicle to the geo-fenced region.

14. The system of claim 9, wherein the at least one physical computer storage medium includes instructions that, when executed by the at least one processor, detect the start of the yard move status by prompting the driver to declare the yard move status.

15. The system of claim 9, wherein the at least one physical computer storage medium includes instructions that, when executed by the at least one processor, detect the start of the yard move status by sensing that the vehicle has started.

16. The system of claim 9, wherein the at least one physical computer storage medium includes instructions that, when executed by the at least one processor, detect the end of the yard move status by prompting the driver to declare the end of the yard move status.

17. The system of claim 9, wherein the at least one physical computer storage medium includes instructions that, when executed by the at least one processor, and using the base unit, detect when the vehicle crosses a geo-fenced boundary.

18. The system of claim 9, wherein the at least one physical computer storage medium includes instructions that, when executed by the at least one processor and using a portable device, prompt the driver to declare the yard move status.

19. The system of claim 9, wherein the at least one physical computer storage medium includes instructions that, when executed by the at least one processor and using a portable device, end a yard move status when the vehicle crosses the geo-fenced boundary.

20. At least one physical computer storage medium comprising stored instructions which when executed detect a yard move status for a driver of a commercial motor vehicle, the at least one physical storage medium comprising instructions which, when executed by a processor, perform operations including:

determining, using a positioning system and a geo-fenced region, a location of the vehicle;

identifying the driver of the commercial motor vehicle who is associated with the yard move status;

detecting a start of the yard move status; and detecting an end of the yard move status.

21. The storage medium of claim 20, wherein the at least one physical computer storage medium includes instructions that, when executed by a processor, define the geo-fenced region.

22. The storage medium of claim 20, wherein the at least one physical computer storage medium includes instructions that, when executed by a processor, compare the location of the vehicle to the geo-fenced region.

23. The storage medium of claim 20, wherein the at least one physical computer storage medium further comprising instructions that, when executed by a processor, detect the start of the yard move status by prompting the driver to declare the yard move status.

24. The storage medium of claim 20, wherein the at least one physical computer storage medium further comprising instructions that, when executed by a processor, detect the start of the yard move status by sensing that the vehicle has started.

25. The storage medium of claim 20, wherein the at least one physical computer storage medium further comprising instructions that, when executed by a processor, detect the end of the yard move status by prompting the driver to declare the end of the yard move status.

26. The storage medium of claim 20, wherein the at least one physical computer storage medium includes instructions that, when executed by the at least one processor and using a portable device, detect when the vehicle crosses the geo-fenced boundary.

27. The storage medium of claim 20, wherein the at least one physical computer storage medium includes instructions that, when executed by the at least one processor and using a portable device, prompt the driver to declare the yard move status.

28. The storage medium of claim 20, wherein the at least one physical computer storage medium includes instructions that, when executed by the at least one processor and using a portable device, end the yard move status when the vehicle crosses the boundary.

* * * * *